US005706683A

United States Patent [19]

Napier

[11] Patent Number: 5,706,683

[45] Date of Patent: Jan. 13, 1998

[54] KEY MECHANISM

[76] Inventor: Robert M. Napier, 1385 W. Washington Blvd., #53, Crescent City, Calif. 95531

[21] Appl. No.: 645,532

[22] Filed: May 14, 1996

[51] Int. Cl.[6] ..... E05B 19/08

[52] U.S. Cl. ..... 70/398; 70/393; 70/395

[58] Field of Search ..... 70/398, 387, 395, 70/456 R, 399, 402, 408, 409, 394; 81/122, 172, DIG. 2

[56] References Cited

U.S. PATENT DOCUMENTS

| | | | |
|---|---|---|---|
| 14,958 | 5/1856 | Hendrickson | 70/398 |
| 181,074 | 8/1876 | Hicks . | |
| 370,734 | 9/1887 | Fryxell | 81/122 |
| 502,060 | 7/1893 | Williams . | |
| 1,215,013 | 2/1917 | Fischer | 70/398 |
| 1,256,288 | 2/1918 | Barnes et al. | 81/DIG. 2 |
| 1,396,861 | 11/1921 | Lucks | 81/DIG. 2 |
| 1,513,212 | 10/1924 | Beale et al. | 81/DIG. 2 |
| 1,523,635 | 1/1925 | Scima | 70/398 |
| 1,630,976 | 5/1927 | Smith | 81/DIG. 2 |
| 1,704,067 | 3/1929 | Wick | 81/DIG. 2 |
| 1,906,978 | 5/1933 | Lemieux | 81/172 |
| 2,837,952 | 6/1958 | Pritchett | 81/172 |
| 3,033,016 | 5/1962 | Moberg | 70/395 |
| 3,125,911 | 3/1964 | Schlote | 81/172 |
| 3,446,045 | 5/1969 | Finck, Jr. | 70/395 |
| 3,478,548 | 11/1969 | Finck, Jr. | 70/387 |
| 3,541,899 | 11/1970 | Tanner | 81/172 |
| 3,555,939 | 1/1971 | Halls | 81/172 |
| 3,640,159 | 2/1972 | Halls et al. | 81/165 |
| 3,673,896 | 7/1972 | Vardaman | 81/165 |
| 4,046,034 | 9/1977 | Flewelling | 81/165 |
| 5,024,565 | 6/1991 | Pinand | 81/DIG. 2 |

FOREIGN PATENT DOCUMENTS

| | | | |
|---|---|---|---|
| 339286 | 12/1930 | United Kingdom | 70/395 |

*Primary Examiner*—Steven N. Meyers
*Assistant Examiner*—Tuyet-Phuong Pham
*Attorney, Agent, or Firm*—James D. Givnan, Jr.

[57] ABSTRACT

A key operating mechanism is embodied in an elongate housing having an axially disposed shaft defining a helical groove. A shaft end is provided with a key to which rotation is imparted by an actuator slidably disposed on the shaft. A drive member of the actuator cooperates with the helical groove in the shaft to impart rotation to the latter and may serve as a detent to prevent actuator movement. Spring elements, oppositely disposed from the actuator, serve to return the actuator to a neutral or static position wherefrom rotation in either direction may be imparted to the shaft. A thumb operated control button of the actuator slides within a housing defined slot during operation of the mechanism.

8 Claims, 1 Drawing Sheet

KEY MECHANISM

BACKGROUND OF THE INVENTION

The present invention pertains generally to key mechanisms wherein a key equipped shaft is rotatably mounted within a housing with means imparting rotation to said shaft.

In the prior art U.S. Pat. No. 181,074 discloses a watch-key having a key bearing shaft to which rotational movement is imparted by a manually actuated member apparently for the winding of a clock.

U.S. Pat. No. 502,061 discloses a watch-key wherein a plunger element is equipped with a helical groove and cam-lugs for imparting rotary motion to a key equipped shaft. A compression spring biases the plunger to an extended position.

In certain uses of keys, in particular the locking and unlocking of handcuffs, adequate clearance is not always available for unhindered rotation of a handcuff key. Further, the unlocking of handcuffs, in some instances, can require approximately full key rotation of 360°.

Well known in the screwdriver prior art are manually powered screwdrivers having a shaft with a double helix for driving and backing out screws.

To the extent the prior art is known, no key mechanism is suitable for rapidly unlocking handcuffs which constitutes a problem when several prisoners must be released from handcuffs at one time, as for example, when transferring shackled prisoners from one site to another.

SUMMARY OF THE PRESENT INVENTION

The present invention is embodied within a key mechanism utilizing a rotatable member for imparting rapid rotation to a key component.

A housing is provided in which a shaft is journaled with the shaft having a helical surface which coacts with the manually actuated member to drive the shaft in a desired direction. Resilient means within the housing serve to return the actuated member to a neutral or static position. Rotation of the key equipped shaft may be in a selected direction to accommodate the lock mechanism being operated.

A drive member is disposed to engage a helical surface and, upon being manually displaced, imparts rotation to the key equipped shaft. Such rotation in an opposite direction may be achieved by manipulation of the drive member in an opposite direction. In either instance provision is made for return or repositioning of the drive member to a static or neutral position by the action of resilient means acting on an actuator which carries the drive member. Accordingly, rapid rotation of the key bearing shaft may be attained to quickly unlock an article such as handcuffs regardless of access to the handcuffs or other article being somewhat hindered.

Important objectives of the present invention include the provision of a key mechanism with a key equipped shaft rotatable in either direction; the provision of a key mechanism having a manually actuated drive member automatically repositioned to a neutral position at the end of an operative sequence; the provision of a key mechanism which provides access to the unlocking mechanism of handcuffs regardless of such access being hindered by close proximity of the wearer's hands and wrists.

DETAILED DESCRIPTION OF THE PREFERRED EMBODIMENTS

Figures 1, 2, 3:
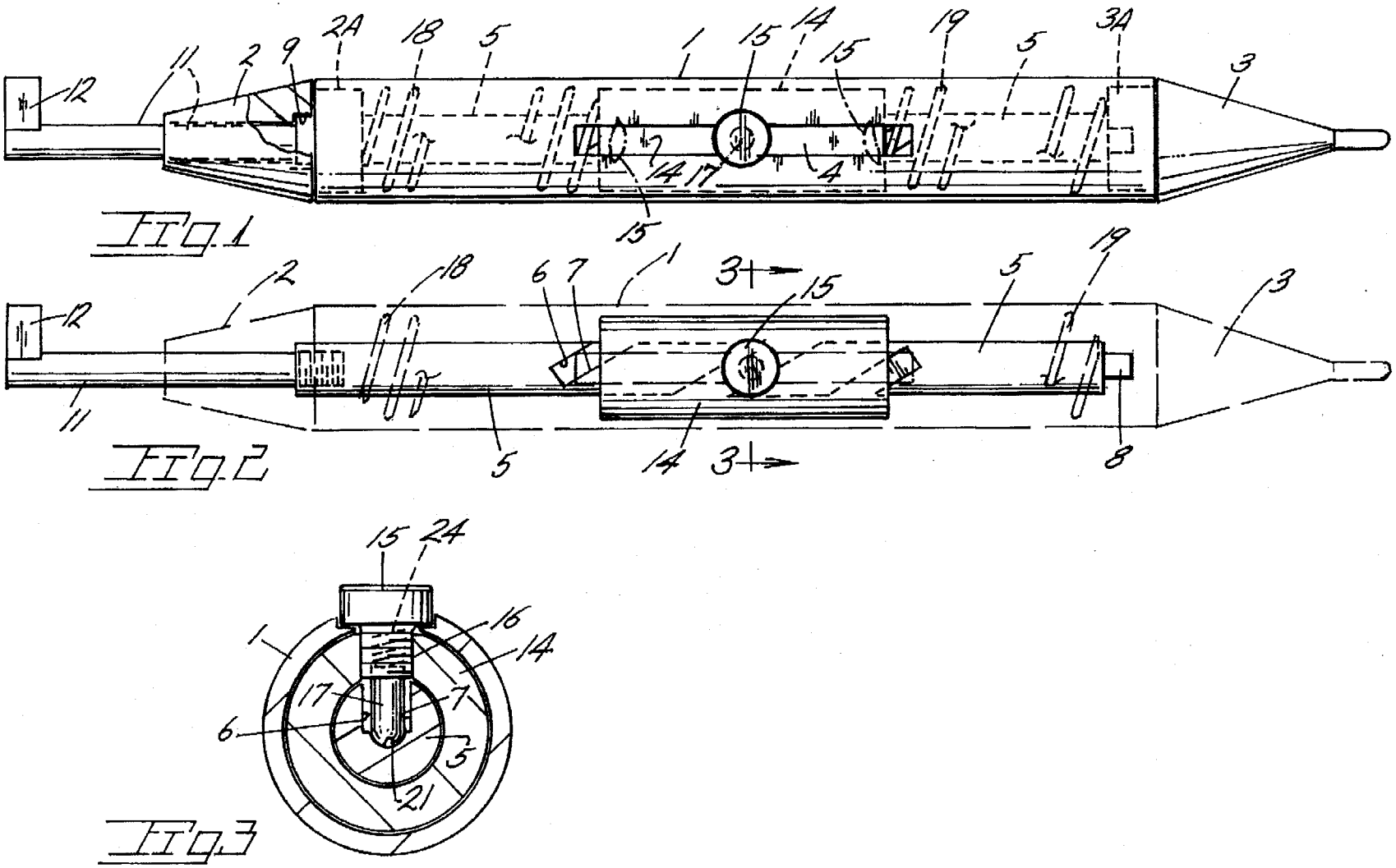
FIG. 1 is a plan view of the present key mechanism.
FIG. 2 is a view similar to FIG. 1 with a housing component of the mechanism shown in phantom lines for purposes of illustration of internal parts.
FIG. 3 is a vertical sectional view taken along line 3—3 of FIG. 2.

With continuing attention to the drawings, wherein applied reference numerals indicate parts similarly hereinafter identified, the reference numeral 1 indicates a housing of the present key mechanism.

The housing is of elongate tubular nature closed at its ends by end members 2 and 3 which are externally threaded at 2A and 3A for housing attachment. Intermediate the ends of the housing is a slot 4.

Axially disposed within housing 1 is a shaft 5 with a groove defined by helical surfaces 6 and 7. A reduced end 8 of the shaft is journaled within end member 3 while the remaining end of shaft 5 seats within a counter bore 9 in end member 2. A shaft extension is at 11 which terminates in a key 12.

Slidably disposed on shaft 5 is an actuator 14 having a finger actuated button or control 15 located exteriorly of housing 1 for travel lengthwise of slot 4. With attention to FIG. 3, it will be seen that control 15 has a threaded shaft 16 in threaded engagement with actuator 14 and a drive stud or member 17 in the groove defined by helical wall surfaces 6 and 7. Forces manually applied to button or control 15 accordingly impart rotational movement to shaft 5, the direction of which will depend on the direction control 15 is momentarily displaced in slot 4. For sufficient rotation of shaft 5, the surfaces 6 and 7 define a helix extending helically through at least 270° in each direction from a groove midpoint to enable drive stud 17 to impart sufficient rotation to key 12 when the key mechanism is intended for use with handcuffs.

Actuator 14 is biased by compression first and second springs 18 and 19 oppositely disposed relative actuator 14 to bias same toward the neutral or static position shown. Spring 18 or spring 19 is compressed during actuator movement and, upon release of control 15, the actuator is automatically returned to the neutral position shown. During return of the actuator, shaft 5 and key 12 are rotated to return to the static position shown. A recess 21 in a bottom wall of grooved shaft 5 serves to receive the end of drive stud or detent 17, biased by a spring 24, which retains actuator 14 in place against undesired fore and aft displacement when independent rotation of shaft 5 is undesired in an unlocking operation.

In use with handcuffs, the key is readily insertable into the key hole of a handcuff whereupon key rotation is achieved in a rapid manner by the operator's thumb on control 15 to minimize the clearance necessary and time required for an unlocking sequence. The present mechanism is equally suited for use with locks having clockwise or counterclockwise unlocking directions.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A key mechanism including, an elongate housing, a shaft journalled in said housing and having a helical surface, said shaft having an end segment terminating exteriorly of the housing, a key on said end segment, an actuator for rectilinear movement relative said housing and including a control having a drive member slidally engageable with said helical surface, first and second resilient means oppositely disposed from and biasing said actuator and said drive member toward a static position medially of said ends of the helical surface, and said control enabling selective rectilinear movement of the actuator and drive member lengthwise of said housing for rotation of said shaft and said key.

2. The key mechanism claimed in claim 1 wherein said resilient means are compression springs.

3. The key mechanism claimed in claim 1 wherein said housing defines a slot, said control slidably supported by said housing in said slot.

4. The key mechanism claimed in claim 1 wherein said actuator and said drive member thereon impart rotation to said key in either direction by selective displacement of said control.

5. The key mechanism claimed in claim 1 wherein said drive member includes a spring biased detent, said shaft defines a recess in which said detent seats to prevent actuator movement when desired.

6. A finger actuated key mechanism including, an elongate tubular housing, a shaft defining a helical groove and journalled in said housing, a shaft end segment projecting from said housing, a key on said end segment, an actuator slidally disposed on said shaft and including a finger actuated control having a drive member in said groove for rectilinear travel within said housing, first and second compression springs in said housing and oppositely disposed from said actuator to retain same in a static position whereat said drive member is located at a point along said groove, and displacement of said control and said drive member by finger imparted force serving to impart rotation to said shaft and said key.

7. The mechanism claimed in claim 6 wherein said actuator and said drive member are biased by said springs to said static position midway along said helical groove with the direction of key rotation determined by the direction of actuator movement along said shaft.

8. The mechanism claimed in claim 7 wherein said shaft defines a recess at a point along said groove, said drive member including a spring urging said drive member into said recess to lock the actuator in place on said shaft.

* * * * *